US012487040B1

(12) United States Patent
Noonan

(10) Patent No.: US 12,487,040 B1
(45) Date of Patent: Dec. 2, 2025

(54) FIREARM

(71) Applicant: F.M. Products Inc, Boise, ID (US)

(72) Inventor: Paul T. Noonan, Boise, ID (US)

( * ) Notice: Subject to any disclaimer, the term of this patent is extended or adjusted under 35 U.S.C. 154(b) by 0 days.

(21) Appl. No.: 18/409,139

(22) Filed: Jan. 10, 2024

Related U.S. Application Data

(60) Provisional application No. 63/438,476, filed on Jan. 11, 2023.

(51) Int. Cl.
*F41A 3/66* (2006.01)
*F41A 9/61* (2006.01)

(52) U.S. Cl.
CPC .. *F41A 3/66* (2013.01); *F41A 9/61* (2013.01)

(58) Field of Classification Search
CPC ..... F41A 3/66; F41A 9/61
See application file for complete search history.

(56) References Cited

U.S. PATENT DOCUMENTS

2005/0183310 A1* 8/2005 Finn ..... F41A 17/42 42/49.01
2016/0258697 A1* 9/2016 Hoon ..... F41A 17/38
2018/0292153 A1* 10/2018 Maga ..... F41A 9/67
2023/0053485 A1* 2/2023 Schoenfeld ..... F41A 9/59

* cited by examiner

*Primary Examiner* — J. Woodrow Eldred

(57) ABSTRACT

An upper receiver is disclosed. The upper receiver contains a first inner surface configured to abut a first magazine protrusion, and a second inner surface configured to abut a second magazine protrusion.

2 Claims, 4 Drawing Sheets

FIREARM

CROSS REFERENCE TO RELATED APPLICATIONS

This application claims the benefit of U.S. Provisional Application No. 63/438,476, filed on Jan. 11, 2023, which is incorporated herein by reference in its entirety.

FIELD

The present invention relates to firearm. More particularly, the present invention relates to a firearm and a method of manufacturing it.

BACKGROUND

Some semiautomatic firearms and their derivatives have removable ammunition magazines. The ammunition magazines hold and supply ammunition to the semiautomatic firearms. During the operation of the semiautomatic firearms, the ammunition magazines tend to move and/or wobble causing the semiautomatic firearms to jam and/or misfire. Therefore, an improvement is needed to prevent these issues.

DETAILED DESCRIPTION

Figure 1:
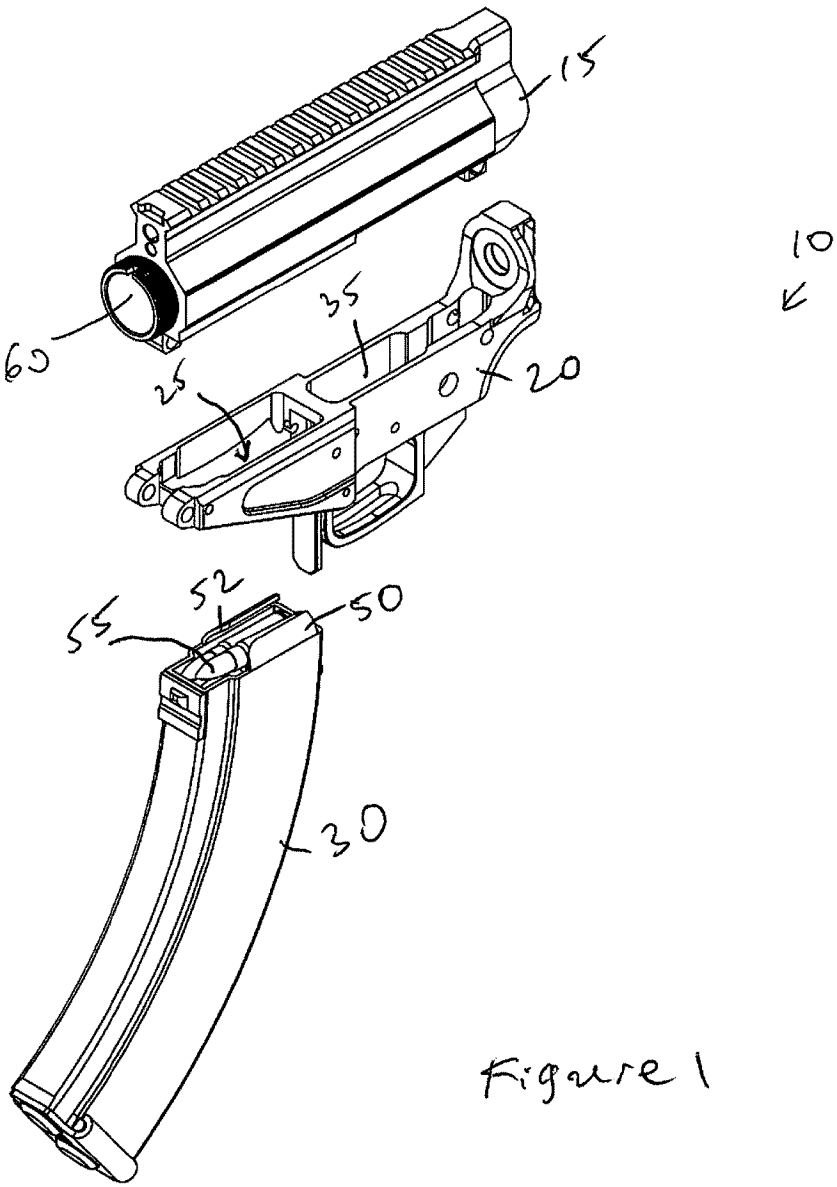
FIG. 1 depicts a partial view of a firearm according to some embodiments presently disclosed.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

As described herein, the term "pivotally connected" shall be used to describe a situation wherein two or more identified objects are joined together in a manner that allows one or both of the objects to pivot, and/or rotate about or in relation to the other object in either a horizontal or vertical manner.

As described herein, the term "removably coupled" and derivatives thereof shall be used to describe a situation wherein two or more objects are joined together in a non-permanent manner so as to allow the same objects to be repeatedly joined and separated.

Also, it is to be understood that the phraseology and terminology used herein is for the purpose of description and should not be regarded as limiting. The use of "including,"

"comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, as described in subsequent paragraphs, the specific mechanical configurations illustrated in the drawings are intended to exemplify embodiments of the invention and that other alternative mechanical configurations are possible.

Referring to FIG. 1, a partial, exploded view, of a firearm 10 is shown according to some embodiments presently disclosed. According to some embodiments presently disclosed, the firearm 10 is an AK-47 type rifle. According to some embodiments presently disclosed, the firearm 10 is an AR type firearm. According to some embodiments presently disclosed, the firearm 10 is an auto-loading firearm. The firearm 10 comprises an upper receiver 15 and a lower receiver 20.

According to some embodiments presently disclosed, the lower receiver 20 comprises openings for accepting the internal mechanisms required to operate the firearm. For example, the lower 20 may comprise a magazine well 25 adapted to receive and hold an ammunition magazine 30 (shown in FIG. 1). The lower receiver 20 may also comprise an opening 35 configured to accommodate a firing mechanism (not shown). The upper receiver 15 may be pivotally coupled with the lower receiver 20 using a fastener 40 (as shown in the FIG. 4).

According to some embodiments presently disclosed, the magazine 30 comprises one or more protrusions 50, 52. According to some embodiments presently disclosed, the magazine 30 comprises two protrusions 50, 52. According to some embodiments presently disclosed, the protrusions 50, 52 are configured to prevent the projectiles 55 from being pushed out of the magazine 30 by a spring assembly (not shown). According to some embodiments presently disclosed, the protrusions 50, 52 are curved. According to some embodiments presently disclosed, the protrusions 50, 52 are curved to prevent the projectiles 55 from being pushed out of the magazine 30 by a spring assembly (not shown).

Figure 2:
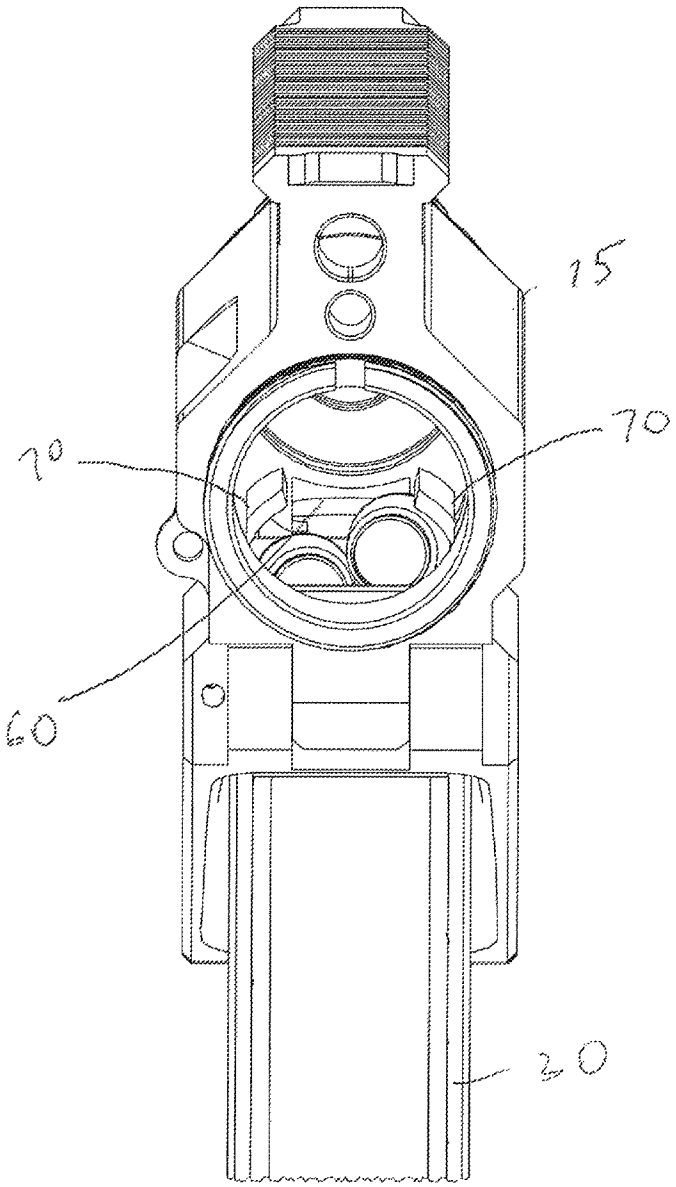
FIG. 2 depicts another partial view of a firearm according to some embodiments presently disclosed.
Figure 3:
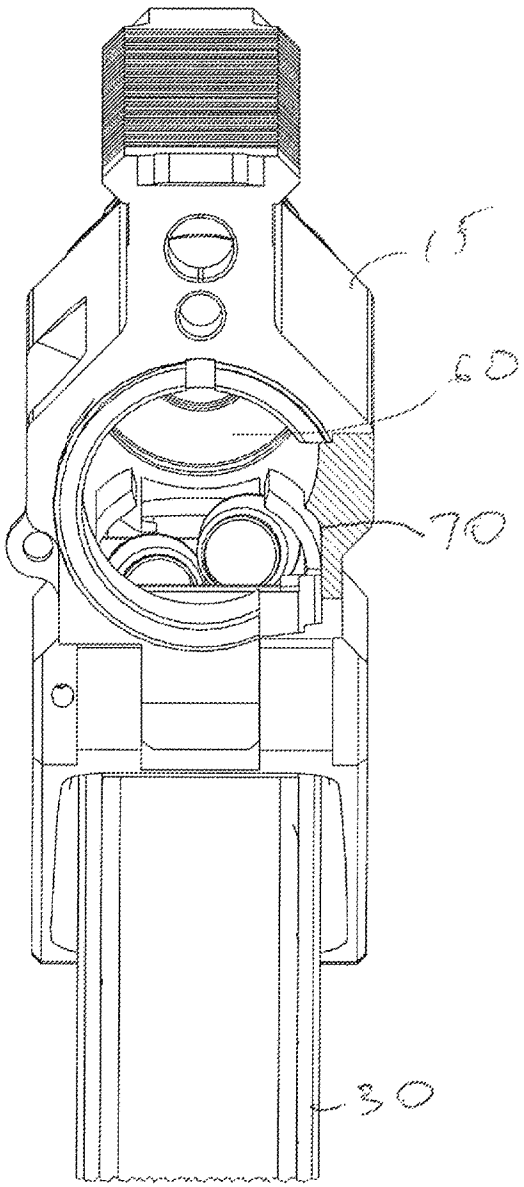
FIG. 3 depicts another partial view of a firearm according to some embodiments presently disclosed.

According to some embodiments presently disclosed, the upper receiver 15 comprises a cavity 60 configured to accommodate a bolt carrier assembly (not shown). According to some embodiments presently disclosed, the upper receiver 15 comprises inner surfaces 70 (shown in FIGS. 2-4). According to some embodiments presently disclosed, the inner surface 70 are curved to accommodate the protrusions 50, 52.

Figure 4:
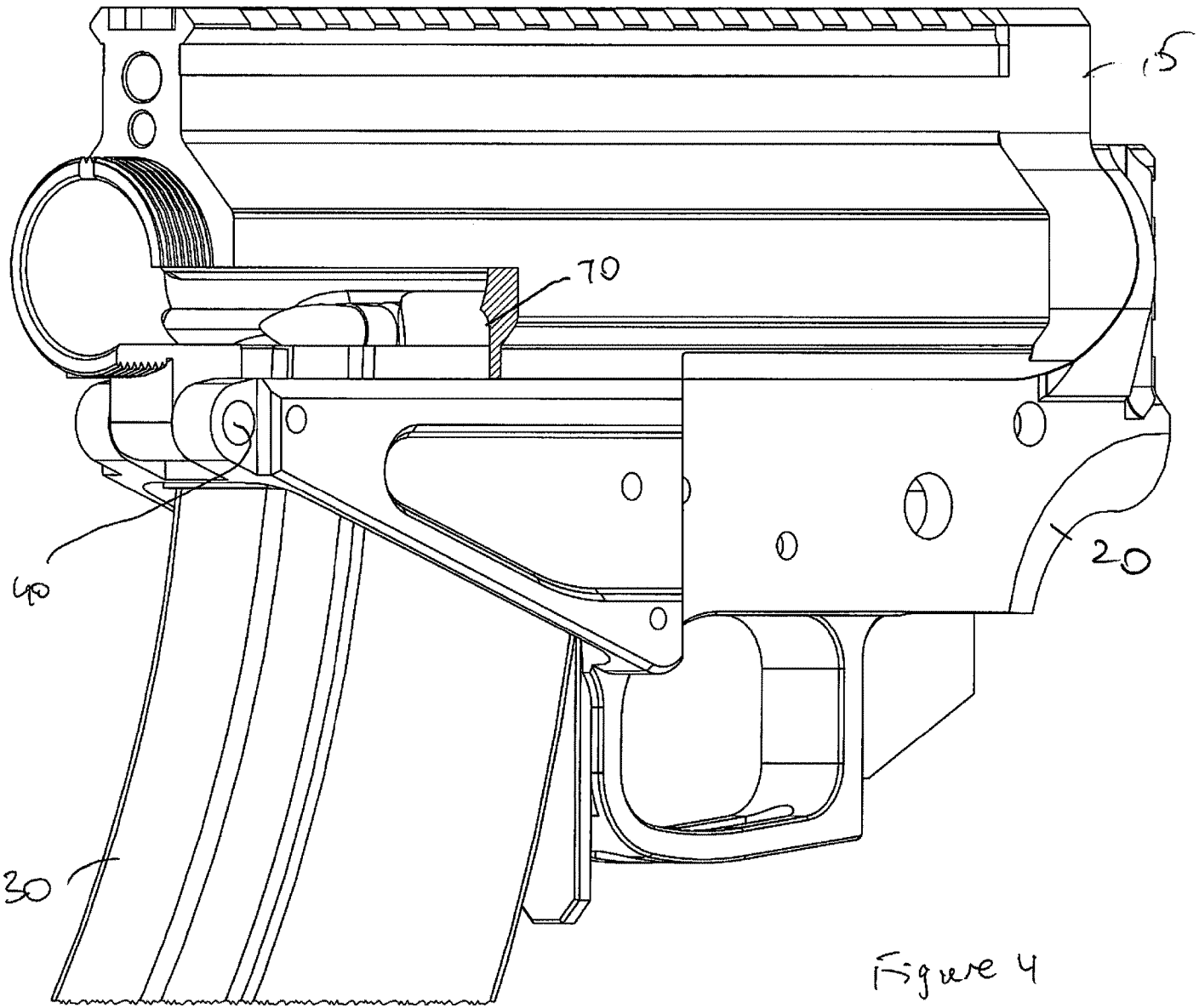
FIG. 4 depicts another partial view of a firearm according to some embodiments presently disclosed.

According to some embodiments presently disclosed, the inner surfaces 70 abut the protrusions 50, 52 when the upper receiver 15 is coupled with the lower receiver (shown in FIG. 4). According to some embodiments presently disclosed, the inner surfaces 70 abut the protrusions 50, 52 and push the protrusions 50, 52 towards each other when the upper receiver 15 is coupled with the lower receiver (shown in FIG. 2). According to some embodiments presently disclosed, the inner surfaces 70 push the protrusions 50, 52 towards each other when the upper receiver 15 is coupled with the lower receiver (shown in FIG. 2).

According to some embodiments presently disclosed, the inner surfaces 70 abut the protrusions 50, 52 to prevent the magazine 30 from moving during operation of the firearm

10. According to some embodiments presently disclosed, the inner surfaces 70 abut the protrusions 50, 52 to prevent the magazine 30 from rocking up and/or down during operation of the firearm 10. According to some embodiments presently disclosed, the inner surfaces 70 abut the protrusions 50, 52 to prevent the magazine 30 from rotating up and/or down during operation of the firearm 10. According to some embodiments presently disclosed, the inner surfaces 70 abut the protrusions 50, 52 to prevent the magazine 30 from pivoting up and/or down during operation of the firearm 10.

It is to be understood that the embodiments described above may be implemented in different types of firearms. The embodiments described above may be implemented in firearms using a blowback system of operation, and/or firearm using a direct impingement system of operation, and/or firearm using piston system of operation. Blowback is a system of operation for self-loading firearms that obtains energy from the motion of the cartridge case as it is pushed to the rear by expanding gas crated by the ignition of the propellant charge. Direct impingement is a type of gas operation for a firearm that directs gas from a fired cartridge directly into the bolt carrier to cycle the action. Piston system uses gas pressure to mechanically move the bolt carrier to cycle the action. It is also to be understood that the embodiments described above may be implemented on M-16 and Armalite style rifles (ARs).

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . "

What is claimed is:

1. An upper receiver comprising:

a first inner surface configured to abut a first magazine protrusion; and a second inner surface configured to abut a second magazine protrusion.

2. The upper receiver of claim 1, wherein the first magazine protrusion and the second magazine protrusion are pushed towards each other by the first inner surface and the second inner surface.

* * * * *